US011460033B2

(12) United States Patent
Chen

(10) Patent No.: US 11,460,033 B2
(45) Date of Patent: Oct. 4, 2022

(54) INFLATION DEVICE

(71) Applicant: Shuobin Chen, Shenzhen (CN)

(72) Inventor: Shuobin Chen, Shenzhen (CN)

( * ) Notice: Subject to any disclaimer, the term of this patent is extended or adjusted under 35 U.S.C. 154(b) by 0 days.

(21) Appl. No.: 17/498,746

(22) Filed: Oct. 12, 2021

(65) Prior Publication Data

US 2022/0025893 A1 Jan. 27, 2022

(51) Int. Cl.
*A47C 27/08* (2006.01)
*F04D 29/60* (2006.01)
*F04D 19/00* (2006.01)

(52) U.S. Cl.
CPC ..... *F04D 19/002* (2013.01); *A47C 27/082* (2013.01); *F04D 19/00* (2013.01); *F04D 29/601* (2013.01); *F04D 29/602* (2013.01)

(58) Field of Classification Search
None
See application file for complete search history.

(56) References Cited

U.S. PATENT DOCUMENTS 2,493,067 A * 1/1950 Goldsmith ..... A47C 21/048 5/726
5,035,398 A * 7/1991 Chiang ..... F04D 29/602 248/674
6,793,469 B2 * 9/2004 Chung ..... F04D 25/084 417/238
6,836,914 B1 * 1/2005 Tsai ..... A47C 27/082 5/713
7,127,762 B1 * 10/2006 Lau ..... A47C 27/082 5/713
7,146,923 B2 * 12/2006 Polley ..... F16K 31/53 114/345
7,571,500 B2 * 8/2009 Wu ..... A47C 27/082 141/197
8,033,800 B2 * 10/2011 Pan ..... F04D 29/503 417/423.14
9,022,051 B2 * 5/2015 Chaffee ..... F16K 15/20 137/15.01
9,157,433 B2 * 10/2015 Wang ..... F04B 49/022
11,058,226 B2 * 7/2021 Hsu ..... F04B 39/123
2004/0037717 A1 * 2/2004 Wang ..... F04D 25/084 417/411
2004/0061318 A1 4/2004 Ord
(Continued)

*Primary Examiner* — Peter J Bertheaud
*Assistant Examiner* — Geoffrey S Lee
(74) *Attorney, Agent, or Firm* — Zhihua Han

(57) ABSTRACT

An inflation device relates to the technical field of inflation equipment. The inflation device includes an inflation shell and a control main board. The inflation shell is arranged in an inflatable product, and is provided with an air outlet cavity; the air outlet cavity is provided with an air outlet; an inflation upper cover and the inflation shell are detachably and fixedly assembled; the inflation upper cover is provided with an air inlet end part; the air inlet end part passes through the inflatable product and extends towards the outer side of the inflatable product; the air inlet end part is provided with an air inlet; the air inlet communicates the air outlet cavity with the outside of the inflatable product. The inflation device using the above technical solution has the advantages of simple and convenient assembling, good leakproofness, high yield, high production efficiency, ingenious design, and easy maintenance.

12 Claims, 8 Drawing Sheets

(56) References Cited

U.S. PATENT DOCUMENTS

| | | | | |
|---|---|---|---|---|
| 2006/0222535 | A1* | 10/2006 | Liu | F04D 25/08 417/423.1 |
| 2010/0006176 | A1 | 1/2010 | Pansegrouw | |
| 2014/0069517 | A1 | 3/2014 | Noca et al. | |
| 2014/0298589 | A1* | 10/2014 | Bailey | A47C 27/10 5/710 |
| 2015/0308454 | A1* | 10/2015 | Shi | F04D 29/503 417/315 |
| 2019/0276118 | A1* | 9/2019 | Heberling, II | B63C 9/24 |

* cited by examiner

INFLATION DEVICE

TECHNICAL FIELD

The present disclosure relates to the technical field of inflation equipment, and specifically relates to an inflation device.

BACKGROUND

With the continuous development of the society, various inflatable products appear on the market, such as: an inflatable cushion, an inflatable sofa, an inflatable tent, an inflatable swimming pool, an inflatable toy, etc. Since the inflatable product can be stored after being deflated, the product is very convenient to store after being deflated, and occupies a small storage space. Therefore, it is favored by the majority of customers.

Most of the existing inflatable products needing to be used is inflated by means of a separate inflation device. However, an air pump is of a huge structure, so it is inconvenient to carry.

SUMMARY

The present disclosure aims to provide an inflation device for the defects and deficiencies in the existing art. The inflation device has the advantages of simple and convenient assembling, good leakproofness, high yield, high production efficiency, ingenious design, and easy maintenance.

In order to achieve the above objective, the technical solution used by the present disclosure is an inflation device. The inflation device is used for supplementing air for an inflatable product, and includes an inflation shell, an inflation upper cover, a fan assembly, a clamping and sealing device, and a control main board. The inflation shell is arranged inside the inflatable product, and is provided with an air outlet cavity; the air outlet cavity is provided with an air outlet; the inflation upper cover is detachably and fixedly assembled with the inflation shell; the inflation upper cover is provided with an air inlet end part; the air inlet end part passes through the inflatable product and extends towards the outer side of the inflatable product; the air inlet end part is provided with an air inlet that communicates the air outlet cavity with the outside of the inflatable product; the fan assembly is arranged in the inflation shell, and is used for conveying air into the inflatable product to fill the inflatable product; the clamping and sealing device is arranged outside the inflatable product and is in pressing fit with the outer wall surface of the inflatable product; the clamping and sealing device is matched with the air inlet end part to realize sealing and fixing between the inflation device and the inflatable product; the control main board is arranged on the inflation upper cover and is connected to the fan assembly to control the fan assembly to be started and stopped.

Further, the inflation upper cover is provided with a flexible silica gel piece; and the flexible silica gel piece is fixed on the inflation upper cover in a high-frequency fitting manner.

Further, an edge of the flexible silica gel piece is provided with a plurality of high-frequency fitting parts that are disposed at intervals.

Further, the clamping and sealing device includes a reverse buckling block protruding from the outer side wall of the air inlet end part; and a cover plate sleeved on the air inlet end part and matched with the reverse buckling block to fix the inflation upper cover on the shell of the inflatable product.

Further, a plurality of reverse buckling blocks are provided, which are annularly distributed on the outer surface of the air inlet end part.

Further, the cover plate is provided with a plurality of clamping parts corresponding to the reverse buckling parts, and avoiding slots are formed in two sides of each clamping part.

Further, the control circuit board is provided with a control element; a soft rubber button is further arranged on the outer side wall of the air inlet end part; and one end of the soft rubber button is sleeved with the operating end of the control element.

Further, a charging port is further formed in the end surface of a side of the air inlet end part away from the inflation shell, and a silica gel sealing cover used for sealing the charging port is arranged at a periphery of the charging port; the air inlet is provided with an air sealing cover; an internal thread is formed on the inner wall of the air inlet; and the air sealing cover is in threaded hermetical assembling with the air inlet.

Further, the inflation shell includes an upper shell and a bottom supporting shell; the upper shell and the bottom are fixedly assembled through a screw; a power supply is arranged in the bottom supporting shell; the power supply is connected with the control circuit board; and a fixing plate used for pressing and fixing the power supply is integrally formed on the upper shell.

Further, the fan assembly includes a motor and a fan blade; the motor is located at the lower part of the air outlet cavity; and a power output shaft passes through the bottom of the air outlet cavity and is in plugged assembling with the fan blade.

Further, a mounting slot is formed in the outer side wall of the air inlet end part in a vertical direction; the clamping and sealing device includes a clamping head assembly that is mounted in the mounting slot, can move in an extending direction of the mounting slot, and is fixed at a moved position; and a cover plate that is sleeved on the air inlet end part and is matched with the clamping head assembly to fix the inflation upper cover on the shell of the inflatable product.

Further, a rack is arranged on the inner side wall of the mounting slot; the clamping head assembly includes a tooth block, a clamping block, and an elastic piece. The tooth block is mounted in the mounting slot; two sides of the tooth block are provided with snap-in tooth parts engaged with the rack; under the driving of an external force, the tooth block can slide relative to the mounting slot; the clamping block is assembled with the tooth block and can synchronously move with the tooth block; the clamping block is used for pressing and fixing the cover plate towards one side of the inflation upper cover; the clamping block can slide along a direction perpendicular to the bottom surface of the mounting slot; the elastic piece is arranged between the tooth block and the clamping block; one end of the elastic piece is fixedly assembled with the tooth block, and the other end is fixedly assembled with the clamping block; and the elastic piece is used for extruding the clamping block towards one side away from the tooth block.

Further, an accommodating slot is formed in a side of the clamping block close to the tooth block; the tooth block and the elastic piece are both mounted in the accommodating slot; a limiting part protrudes from the tooth block; a limiting slot is formed in the inner wall of the accommodating slot;

and the limiting part is used for being matched with the limiting slot to prevent the tooth block from being separated from the clamping block.

Further, a plurality of mounting slots are provided, which are parallel to each other and are annularly distributed on the outer side wall of the air inlet end part; and a plurality of groups of clamping head assemblies, which are in one-to-one correspondence to the plurality of mounting slots.

After the above-mentioned technical solution is used, the present disclosure has the beneficial effects that the flexible silica gel piece is arranged on the inflation upper cover so that when the cover plate is clamped with the reverse buckling blocks, the tightness and the leakproofness of assembling among the shell of the inflatable product, the flexible silica gel piece, and the cover plate can be effectively improved, the structure is simple, and the mounting is convenient. Meanwhile, the flexible silica gel piece and the inflation upper cover are assembled in a high-frequency fitting manner. This manner avoids the problems of low production efficiency, poor leakproofness, and low yield caused by an adhesion fixing manner, and has the advantages of simple and convenient assembling, good leakproofness, high yield, and high production efficiency.

BRIEF DESCRIPTION OF THE DRAWINGS

To describe the embodiments of the disclosure or the technical solutions in the existing art more clearly, drawings required to be used in the embodiments or the illustration of the existing art will be briefly introduced below. Obviously, the drawings in the illustration below are only some embodiments of the disclosure. Those ordinarily skilled in the art also can acquire other drawings according to the provided drawings without doing creative work.

Figure 1:
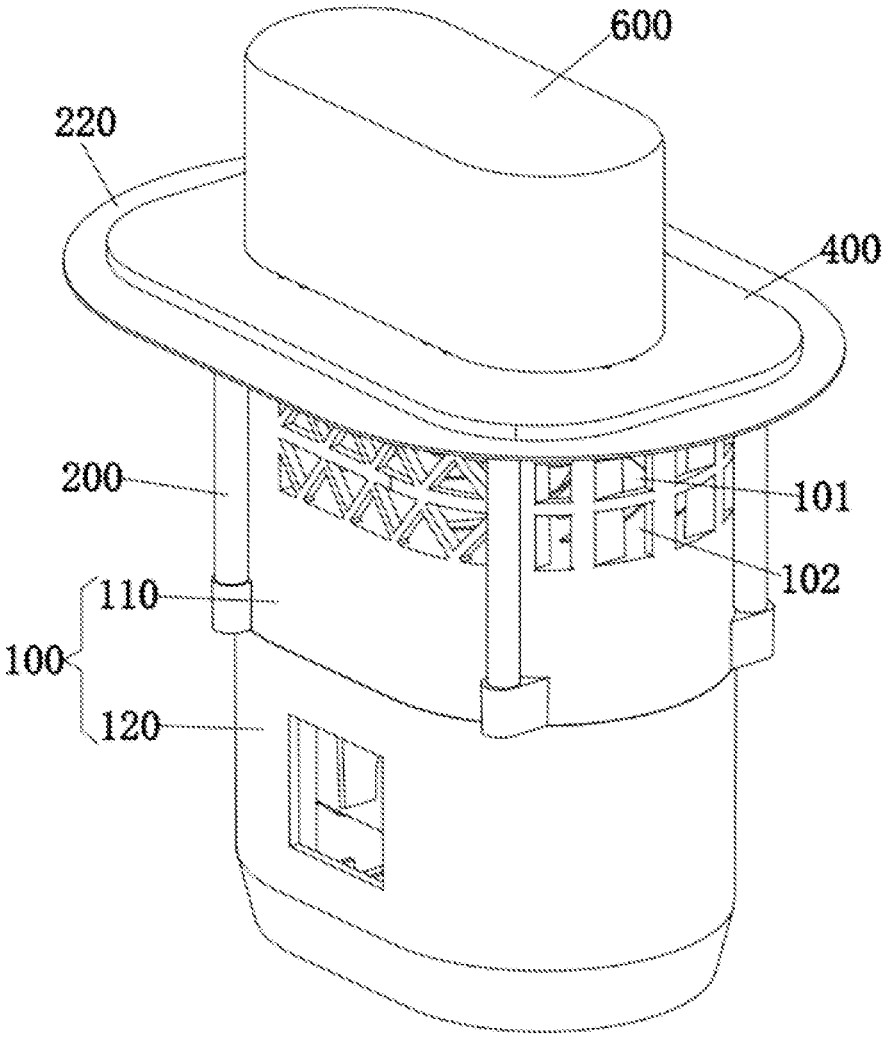
FIG. 1 is a schematic diagram of an entire structure of Embodiment 1.

Reference signs in the drawings: 100: inflation shell; 101: air outlet cavity; 102: air outlet; 110: upper shell; 111: fixed plate; 120: bottom supporting shell; 200: inflation upper cover; 201: air inlet; 202: mounting hole; 210: air inlet end part; 220: flexible silica gel piece; 221: silica gel pillar; 222: wrapping part; 223: mounting slot; 230: soft rubber button; 240: charging port; 250: silica gel sealing cover; 260: air sealing cover; 270: mounting part; 300: fan assembly; 310: motor; 320: fan blade; 400: clamping and sealing device; 401: accommodating slot; 410: reverse buckling block; 420: cover plate; 421: clamping part; 422: avoiding slot; 430: clamping head assembly; 431: tooth block; 432: clamping block; 433: elastic piece; 434: limiting part; 435: rack; 500: power supply; and 600: cap.

DETAILED DESCRIPTION OF THE EMBODIMENTS

The present invention is further described in detail below in combination with accompanying drawings.

This specific embodiment is only an explanation of the present disclosure, and it is not a limitation to the present disclosure. After reading this specification, those skilled in the art can make modifications to this embodiment that do not create any contribution as needed, but the modifications shall be protected by the patent law within the scope of the claims of the present disclosure.

Embodiment 1

Figure 2:
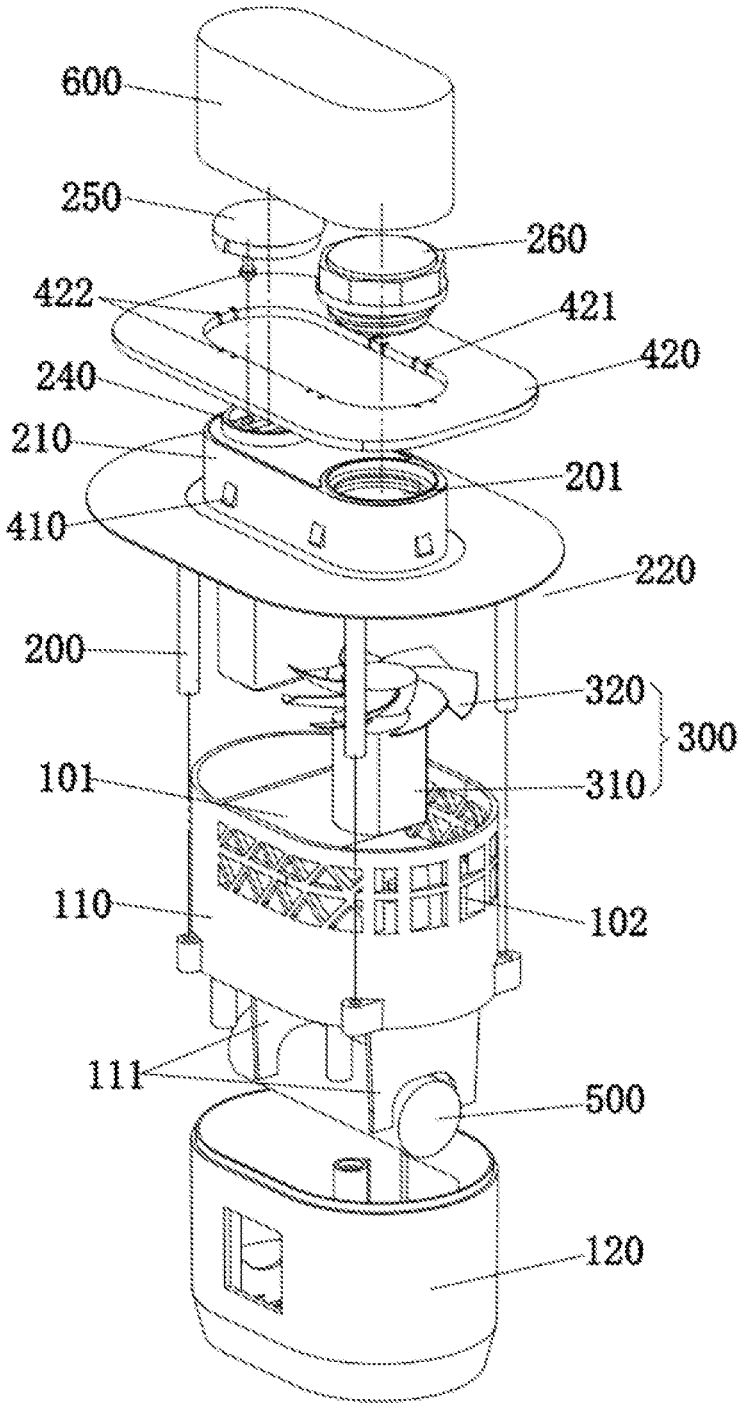
FIG. 2 is an exploded diagram of Embodiment 1.
Figure 3:
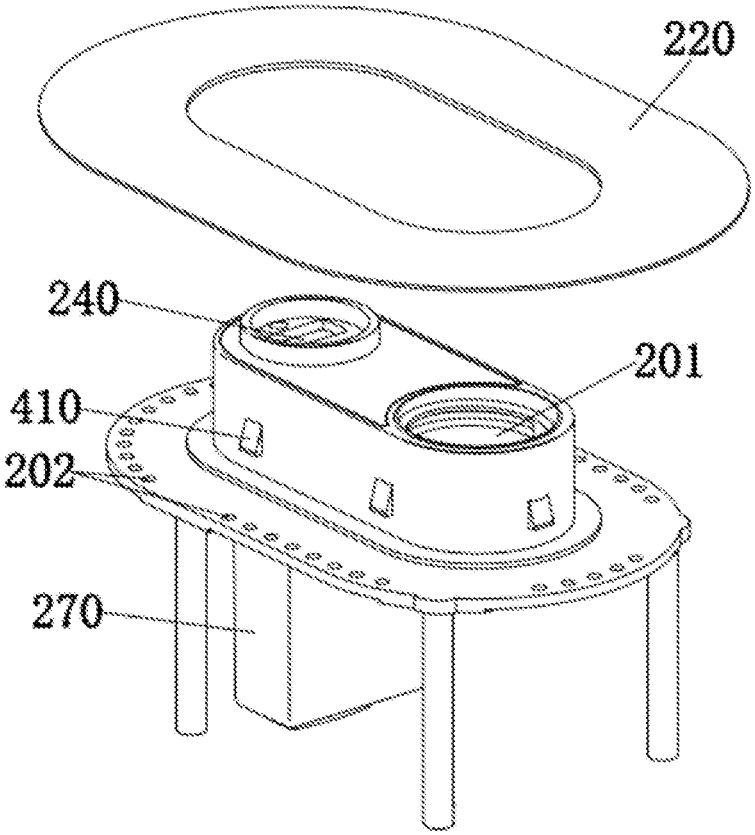
FIG. 3 is a schematic structural diagram of an inflation upper cover and a flexible silica gel piece in Embodiment 1.
Figure 4:
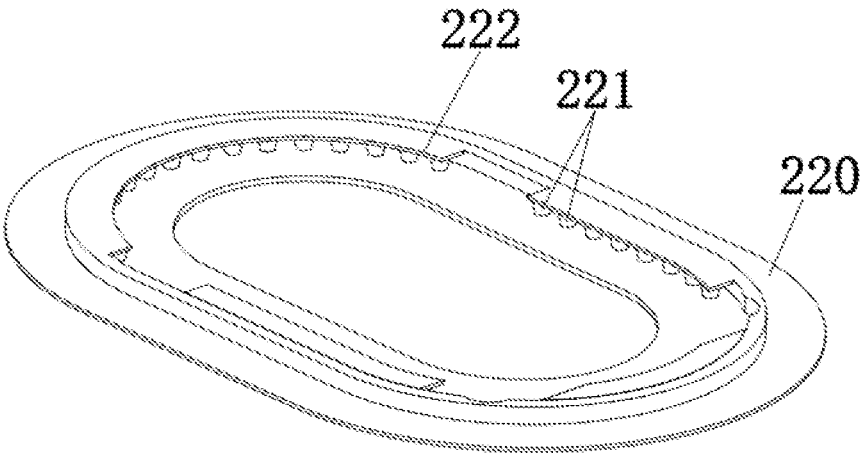
FIG. 4 is a schematic structural diagram of a flexible silica gel piece in Embodiment 1.

The present embodiment relates to an inflation device that is used for supplementing air for an inflatable product. As shown in FIGS. 1-4, the inflation device includes an inflation shell 100, an inflation upper cover 200, a fan assembly 300, a clamping and sealing device 400, and a control main board.

Specifically, the inflation shell 100 is arranged in the inflatable product (such as an inflatable sofa and an inflatable cushion). The inflation shell 100 is provided with an air outlet cavity 101, and the air outlet cavity 101 is provided with an air outlet 102. The inflation upper cover 200 and the inflation shell 100 are detachably and fixedly assembled (screw assembling is used in the present embodiment). The inflation upper cover 200 is provided with an air inlet end part 210, and the air inlet end part 210 passes through the inflatable product and extends to the outer side of the inflatable product. The air inlet end part 210 is provided with an air inlet 201, and the air inlet 201 communicates the air outlet cavity 101 with the outside of the inflatable product. The fan assembly 300 is arranged in the inflation shell 100. The fan assembly 300 is used for conveying air into the inflatable product to fill the inflatable product. The clamping and sealing device 400 is arranged outside the inflatable product and is in pressing fit with the outer wall surface of the inflatable product. The clamping and sealing device 400 is matched with the air inlet end 210 to realize sealing and fixing between the inflation device and the inflatable product. The control main board (not shown in the figure) is arranged on the inflation upper cover 200. The control main board is connected to the fan assembly 300 to control the fan assembly 300 to be started and stopped.

Further, as shown in FIGS. 1-4, the inflation upper cover 200 is provided with a flexible silica gel piece 220; and the flexible silica gel piece 220 is fixed on the inflation upper cover 200 in a high-frequency fitting manner. Preferably, an edge of the flexible silica gel piece 220 is provided with a plurality of high-frequency fitting parts that are disposed at intervals. In the present embodiment, four high-frequency fitting parts are provided. When the flexible silica gel piece 220 is assembled with the inflation upper cover 200, the inflation upper cover 200 is provided with a mounting hole 202, and the flexible silica gel piece 220 is correspondingly provided with a silica gel pillar 221. An edge of the flexible silica gel piece 220 is provided with a plurality of wrapping parts 222, and the wrapping parts 222 are used for wrapping traces of the high-frequency fitting parts.

Further, as shown in FIGS. 1-4. the clamping and sealing device 400 includes a reverse buckling block 410 and a cover plate 420. The reverse buckling block protrudes from the outer side wall of the air inlet end part 210. The cover plate 420 is sleeved on the air inlet end part 210 and is matched with the reverse buckling block 410, so as to fix the inflation upper cover 200 on the shell of the inflatable product.

Preferably, as shown in FIGS. 1-4, a plurality of reverse buckling blocks 410 are provided, which are annularly distributed on the outer surface of the air inlet end part 210.

The cover plate 420 is provided with a plurality of clamping parts 421 corresponding to the reverse buckling parts, and avoiding slots 422 are formed in two sides of each clamping part 421. In the present embodiment, there are six reverse buckling blocks 410 and six corresponding clamping parts 421. The six clamping parts 421 and the cover plate 420 are integrally molded. The six reverse buckling blocks 410 and the air inlet end part 210 are integrally molded. The reverse buckling block 410 is a wedge-shaped block, and a wedge-shaped surface of the wedge-shaped block tilts from its bottom to one side of the outer side wall of the air inlet end part 210.

Preferably, the control circuit board is provided with a control element; a soft rubber button 230 is further arranged on the outer side wall of the air inlet end part 210; and one end of the soft rubber button 230 is sleeved with the operating end of the control element.

Further, as shown in FIGS. 1-4, a charging port 240 is further formed in the end surface of a side of the air inlet end part 210 away from the inflation shell 100, and a silica gel sealing cover 250 used for sealing the charging port 240 is arranged at a periphery of the charging port 240. The air inlet 201 is provided with an air sealing cover 260; an internal thread is formed on the inner wall of the air inlet 201; and the air sealing cover 260 is in threaded hermetical assembling with the air inlet 201.

It is worth noting that as shown in FIGS. 1-4, a round hole is formed in a periphery of the charging port 240. The silica gel sealing cover 250 is provided with an anti-separation pillar; the anti-separation pillar is mounted in the round hole; the lower end of the anti-separation pillar is provided with a conical anti-separation part; and the size of the conical anti-separation part is greater than that of the round mounting hole 202. In this way, the silica gel sealing piece can effectively prevent loss and is convenient to use. In addition, a silica gel sealing ring is arranged between the air sealing cover 260 and the air inlet 201, so as to effectively guarantee the leakproofness of the air inlet 201 after use. The inflation upper cover 200 is further provided with a mounting part 270 for mounting the control circuit board, and the mounting part 270 downwards extends into a bag shape. The air inlet end part 210 is further sleeved with a cap, so as to protect the air inlet 201 and the charging port 240.

Further, as shown in FIGS. 1-4, the inflation shell 100 includes an upper shell 110 and a bottom supporting shell 120. The upper shell 110 and the bottom are fixedly assembled through a screw. A power supply 500 is arranged in the bottom supporting shell 120, and is connected to the control circuit board. The upper shell 110 is integrally provided with a fixing plate 111 used for pressing and fixing the power supply 500. In the present embodiment, the upper shell 110 is divided by partition plates to form three spaces. One space is the air outlet cavity 101, and is located below the air outlet cavity 101 for mounting the motor 310. Another space is a cavity for accommodating the bag-shaped mounting part 270.

Further, as shown in FIGS. 1-4, the fan assembly 300 includes a motor 310 and a fan blade 320. The motor 310 is located at the lower part of the air outlet cavity 101, and a power output shaft passes through the bottom of the air outlet cavity 101 and is in plugged assembling with the fan blade 320. The motor 310 is fixedly assembled with the bottom of the air outlet cavity 101 through two fastening screws.

The working principle of the present embodiment is approximately as follows: the flexible silica gel piece 220 is arranged on the inflation upper cover 200 so that when the cover plate 420 is clamped with the reverse buckling blocks 410, the tightness and the leakproofness of assembling among the shell of the inflatable product, the flexible silica gel piece 220, and the cover plate 420 can be effectively improved, the structure is simple, and the mounting is convenient. Meanwhile, the flexible silica gel piece 220 and the inflation upper cover 200 are assembled in a high-frequency fitting manner. This manner avoids the problems of low production efficiency, poor leakproofness, and low yield caused by an adhesion fixing manner, and has the advantages of simple and convenient assembling, good leakproofness, high yield, and high production efficiency.

Embodiment 2

Figure 5:
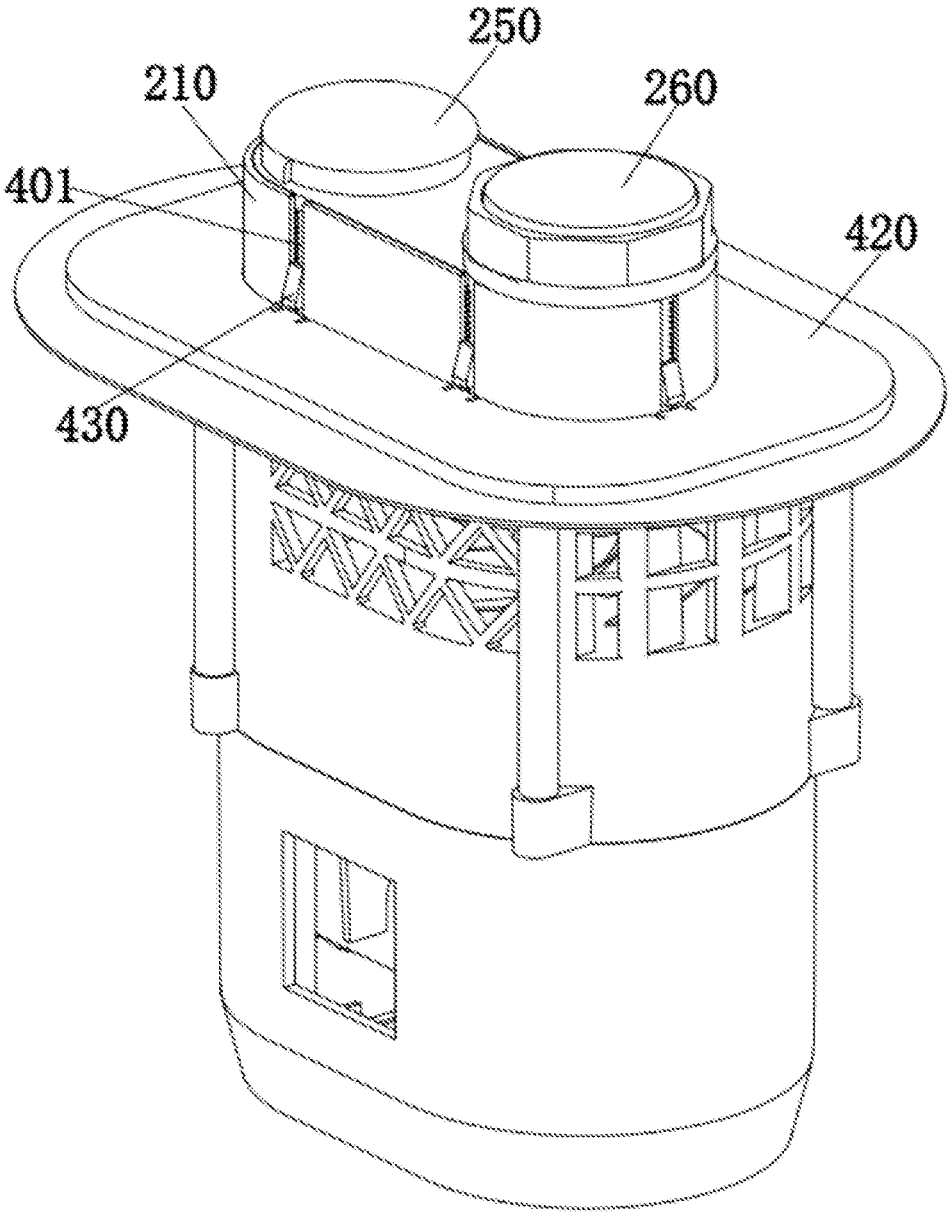
FIG. 5 is a schematic diagram of an entire structure after a cap is taken out in Embodiment 2.
Figure 6:
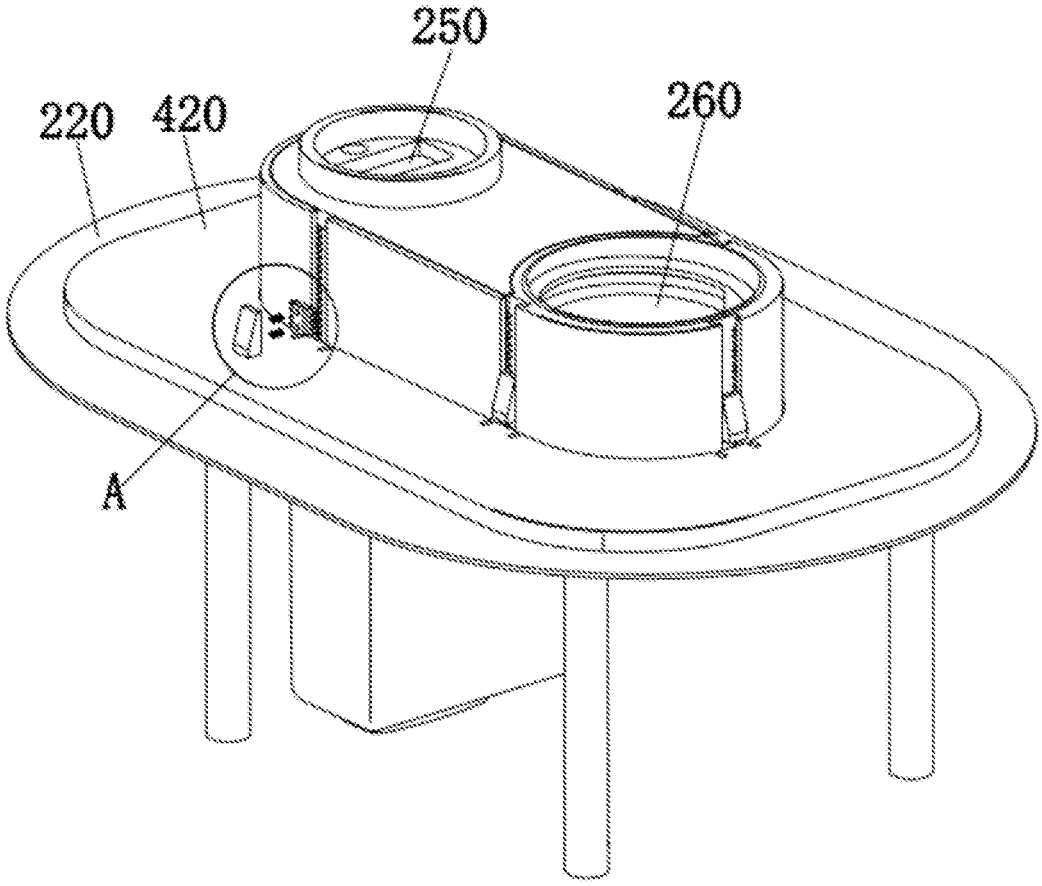
FIG. 6 is a schematic structural diagram of an inflation upper cover and a flexible silica gel piece in Embodiment 2.
Figure 7:
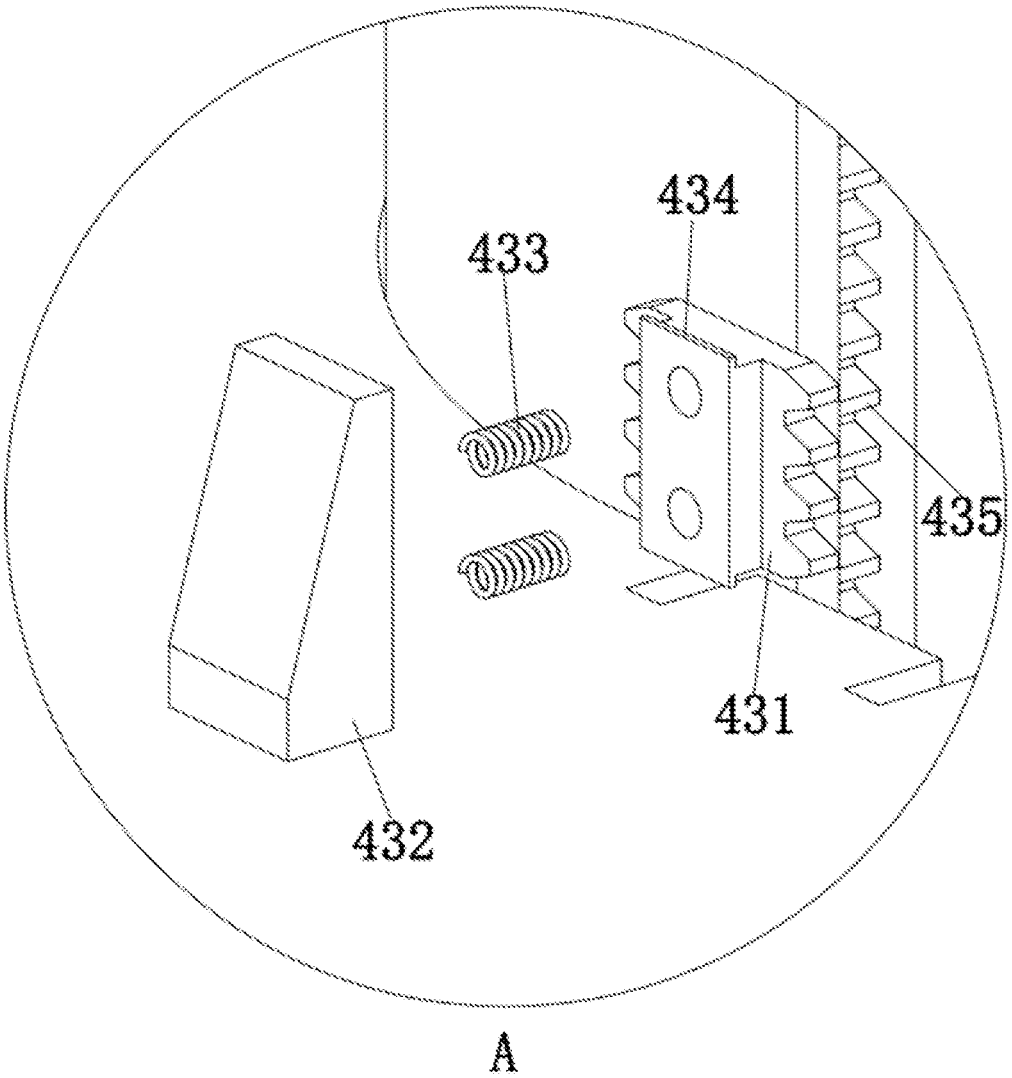
FIG. 7 is an enlarged diagram of detail A corresponding in FIG. 6.
Figure 8:
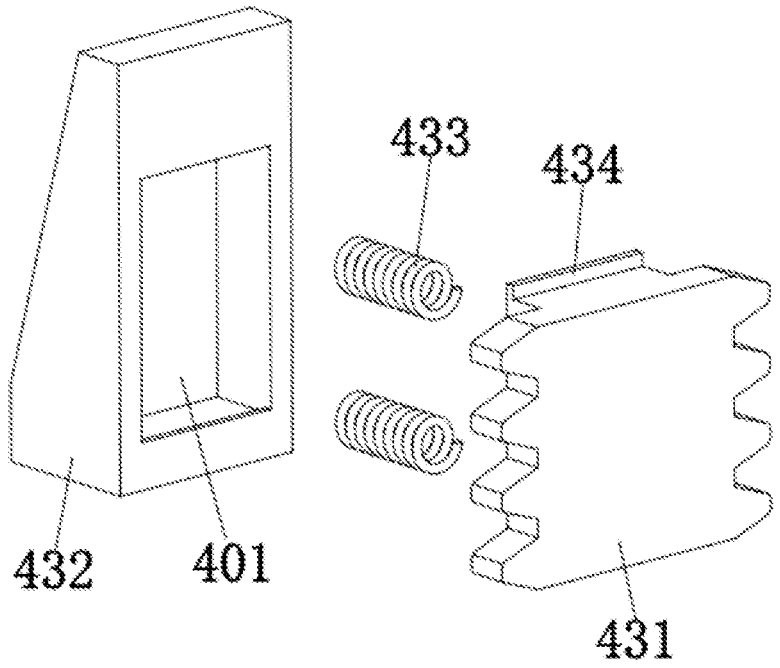
FIG. 8 is a schematic structural diagram of a clamping head assembly in Embodiment 2.

A difference between the present embodiment and Embodiment 1 mainly lies in that as shown in FIGS. 5-8, in the present embodiment, a mounting slot 223 is formed in the outer side wall of the air inlet end part 210 in a vertical direction. The clamping and sealing device 400 includes a clamping head assembly 430 and a cover plate 420. The clamping head assembly 430 is mounted in the mounting slot 223, can move in an extending direction of the mounting slot 223, and is fixed at a moved position. The cover plate 420 is sleeved on the air inlet end part 210 and is matched with the reverse buckling block 430, so as to fix the inflation upper cover 200 on the shell of the inflatable product. It should be noted that the clamping head assembly 430 and the mounting slot 223 are slidably assembled so that the inflation device is used on inflatable products with different shell thicknesses and is adaptively adjusted by means of adjusting the position of the clamping head assembly 430. Meanwhile, the tightness and leakproofness of assembling of the clamping and sealing device 400 can be improved by means of pressing the clamping head assembly 430.

Further, as shown in FIGS. 5-8, a rack 435 is arranged on the inner side wall of the mounting slot 223. The clamping head assembly 430 includes a tooth block 431, a clamping block 432, and an elastic piece 433.

Specifically, the tooth block 431 is mounted in the mounting slot 223. Two sides of the tooth block 431 are provided with snap-in tooth parts engaged with the rack 435. Under the driving of an external force, the tooth block 431 can slide relative to the mounting slot 223. The clamping block 432 is assembled with the tooth block 431 and can synchronously move with the tooth block 431. The clamping block 432 is used for pressing and fixing the cover plate 420 towards one side of the inflation upper cover 200. The clamping block 432 can slide along a direction perpendicular to the bottom surface of the mounting slot 223. The elastic piece 433 is arranged between the tooth block 431 and the clamping block 432. One end of the elastic piece 433 is fixedly assembled with the tooth block 431, and the other end is fixedly assembled with the clamping block 432. The elastic piece 433 is used for extruding the clamping block 432 towards one side away from the tooth block 431.

It is worth noting that as shown in FIGS. 5-8, the clamping block 432 is slidably assembled with the tooth block 431. Generally, the clamping block 432 moves towards a side away from the bottom surface of the mounting slot 223 under the action of the elasticity of the elastic piece 433 so that the clamping block 432 protrudes from the outer wall surface of the air inlet end part 210 to clamp and fix the cover plate 420. During removal, the clamping block 432 is pressed to retract into the mounting slot, which facilitates the removal of the cover plate 420. When the tooth block 431 needs to be adjusted, a user can push the clamping block 432 to transmit motion to the tooth block 431 by means of the clamping block 432 and drive the tooth block 431 to slide relative to the mounting slot 223, so as to complete the adjustment of the position of the tooth block 431. The elastic piece 433 is a spring. In other embodiments, the elastic piece 433 may also be an elastic block or a clip.

Preferably, as shown in FIGS. 5-8, a side of the clamping block 432 close to the tooth block 431 is provided with an accommodating slot 401, and the tooth block 431 and the elastic piece 433 are both mounted in the accommodating slot 401. A limiting part 434 protrudes from the tooth block 431, and a limiting slot (not shown in the figure) is formed in the inner wall of the accommodating slot 401. The limiting part 434 is used to be matched with the limiting slot, so as to prevent the tooth block 431 from being separated from the clamping block 432.

Preferably, as shown in FIGS. 5-8, a plurality of mounting slots 223 are provided, which are parallel to each other and are annularly distributed on the outer side wall of the air inlet end part 210. A plurality of groups of clamping head assemblies 430 are provided, which are in one-to-one correspondence to the plurality of mounting slots 223.

The above is only used to explain the technical solution of the present disclosure, but not to limit the technical solution. Other modifications or equivalent substitutions made by those of ordinary skill in the art to the technical solution of the present disclosure shall fall within the scope of the claims of the present disclosure without departing from the spirit and scope of the technical solution of the present disclosure.

What is claimed is:

1. An inflation device, which is used for supplementing air to an inflatable product and comprises: an inflation shell (100) which is arranged inside the inflatable product and is provided with an air outlet cavity (101), wherein the air outlet cavity (101) is provided with an air outlet (102); an inflation upper cover (200) which is detachably and fixedly assembled with the inflation shell (100), wherein the inflation upper cover (200) is provided with an air inlet end part (210); the air inlet end part (210) passes through the inflatable product and extends towards the outer side of the inflatable product; the air inlet end part (210) is provided with an air inlet (201) that communicates the air outlet cavity (101) with the outside of the inflatable product; a fan assembly (300) which is arranged in the inflation shell (100), and is used for conveying air into the inflatable product to fill the inflatable product; a damping and sealing device (400) which is arranged outside the inflatable product and is in pressing fit with the outer wall surface of the inflatable product, wherein the damping and sealing device (400) is matched with the air inlet end part (210) to realize sealing and fixing between the inflation device and the inflatable product; and a control main board which is arranged on the inflation upper cover (200) and is connected to the fan assembly (300) to control the fan assembly (300) to be started and stopped; wherein the inflation upper cover (200) is provided with a flexible silica gel element; and the flexible silica gel element is configured to fix the inflation upper cover (200) in a high-frequency fitting manner.

2. The inflation device according to claim 1, wherein an edge of the flexible silica gel element as provided with a plurality of high-frequency fitting parts that are disposed at intervals.

3. The inflation device according to claim 2, wherein the clamping and sealing device (400) comprises a reverse buckling block (410) protruding from the outer side wall of the air inlet end part (210); and a cover plate (420) sleeved on the air inlet end part (210) and matched with the reverse buckling block (410) to fix the inflation upper cover (200) on the shell of the inflatable product.

4. The inflation device according to claim 3, wherein a plurality of reverse buckling blocks (410) are provided, which are annularly distributed on the outer surface of the air inlet end part (210).

5. The inflation device according to claim 4, wherein the cover plate (420) is provided with a plurality of clamping parts (421) corresponding to the reverse buckling parts, and avoiding slots (422) are formed in two sides of each clamping part (421).

6. The inflation device according to claim 2, wherein a mounting slot (223) is formed in the outer side wall of the air inlet end part (210) in a vertical direction; the clamping and sealing device (400) comprises:

a clamping head assembly (430) that is mounted in the mounting slot (223), can move in an extending direction of the mounting slot (223), and is fixed at a moved position; and a cover plate (420) that is sleeved on the air inlet end part (210) and is matched with the clamping head assembly (430) to fix the inflation upper cover (200) on the shell of the inflatable product.

7. The inflation device according to claim 6, wherein a rack (435) is arranged on the inner side wall of the mounting slot (223); the clamping head assembly (430) comprises:

a tooth block (431) which is mounted in the mounting slot (223), wherein two sides of the tooth block (431) are provided with snap-in tooth parts engaged with the rack (435); under the driving of an external force, the tooth block (431) is capable of sliding relative to the mounting slot (223);

a clamping block (432) which is assembled with the tooth block (431) and is capable of synchronously moving with the tooth block (431), wherein the clamping block (432) is used for pressing and fixing the cover plate (420) towards one side of the inflation upper cover (200); the clamping block (432) is capable of sliding along a direction perpendicular to the bottom surface of the mounting slot (223);

and an elastic piece (433) which is arranged between the tooth block (431) and the clamping block (432); one end of the elastic piece (433) is fixedly assembled with the tooth block (431), and the other end is fixedly assembled with the clamping block (432); and the elastic piece (433) is used for extruding the clamping block (432) towards one side away from the tooth block (431).

8. The inflation device according to claim 7, wherein an accommodating slot (401) is formed in a side of the clamping block (432) close to the tooth block (431); the tooth block (431) and the elastic piece (433) are both mounted in the accommodating slot (401); a limiting part (434) protrudes from the tooth block (431); a limiting slot is formed in the inner wall of the accommodating slot (401); and the limiting part 434) is used for being matched with the limiting slot to prevent the tooth block (431) from being separated from the clamping block (432).

9. The inflation device according to claim 6, wherein a plurality of mounting slots (223) are provided, which are parallel to each other and are annularly distributed on the outer side wall of the air inlet end part (210); and a plurality of groups of clamping head assemblies (430), which are in one-to-one correspondence to the plurality of mounting slots (223).

10. The inflation device according to claim 9, wherein a charging port (240) is further formed in the end surface of a side of the air inlet end part (210) away from the inflation shell (100), and a silica gel sealing cover (250) used for sealing the charging port (240) is arranged at a periphery of the charging port (240); the air inlet (201) is provided with an air sealing cover (260); an internal thread is formed on the inner wall of the air inlet (201); and the air sealing cover (260) is in threaded hermetical assembling with the air inlet (201).

11. The inflation device according to claim 9, wherein the inflation shell (100) comprises an upper shell (110) and a bottom supporting shell (120); the upper shell (110) and the bottom are fixedly assembled through a screw; a power supply (500) is arranged in the bottom supporting shell (120); the power supply (500) is connected with the control circuit board; and a fixing plate (111) used for pressing and fixing the power supply (500) is integrally formed on the upper shell (110).

12. The inflation device according to claim 9, wherein the fan assembly (300) comprises a motor (310) and a fan blade (320); the motor (310) is located at the lower part of the air outlet cavity (101); and a power output shaft passes through the bottom of the air outlet cavity (101) and is in plugged assembling with the fan blade (320).

* * * * *